US005099551A

United States Patent [19]

Hyun

[11] Patent Number: 5,099,551

[45] Date of Patent: Mar. 31, 1992

[54] CONNECTOR DEVICE FOR JEWELRY

[76] Inventor: Kwang H. Hyun, 2600 Tarrytown Dr., Fullerton, Calif. 92633

[21] Appl. No.: 664,351

[22] Filed: Mar. 4, 1991

[51] Int. Cl.[5] ..... A44C 5/00

[52] U.S. Cl. ..... 24/616; 24/116 A; 24/618

[58] Field of Search ..... 24/616, 618, 116 A

[56] References Cited

U.S. PATENT DOCUMENTS

| | | | |
|---|---|---|---|
| 1,421,388 | 7/1922 | Bippart | 24/616 |
| 1,477,597 | 12/1923 | Schneider | 24/616 |
| 1,631,824 | 6/1927 | Jones | 24/616 |
| 2,477,354 | 7/1949 | Teolis | 24/616 |
| 2,986,792 | 6/1961 | Wyatt | 24/616 |
| 3,462,807 | 8/1969 | Marquardt | 24/616 |
| 4,426,854 | 1/1984 | Geldwerth et al. | 24/616 |
| 4,881,305 | 11/1989 | Rivera | 24/618 |

FOREIGN PATENT DOCUMENTS

| | | | |
|---|---|---|---|
| 0860867 | 1/1941 | France | 24/616 |
| 0200587 | 12/1965 | Switzerland | 24/618 |

*Primary Examiner*—Victor N. Sakran
*Attorney, Agent, or Firm*—Erik M. Arnhem

[57] ABSTRACT

A mechanism for releasably connecting the ends of a bracelet, necklace or watchband. The mechanism includes a male connector component slidably insertable into a female connector component. Two resiliently-biased arms on the male component ride along inturned flanges in the female connector, after which the arms spring outwardly to lock against interior side faces of the flanges. Two squeezable handles extend from the arms for moving the arms together, thereby enabling the male connector element to be withdrawn from the hollow female element.

6 Claims, 2 Drawing Sheets

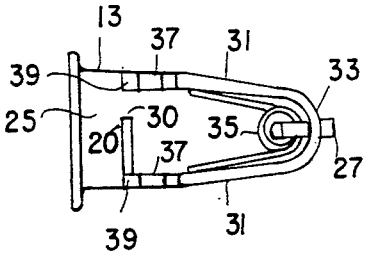
FIG. 1.
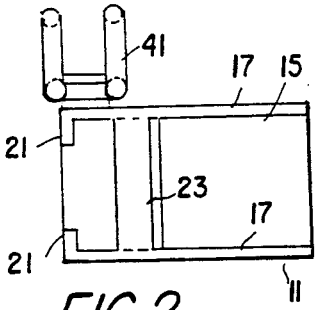
FIG. 2.
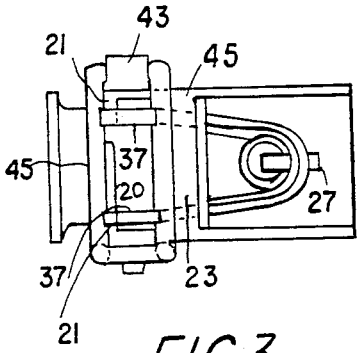
FIG. 3.
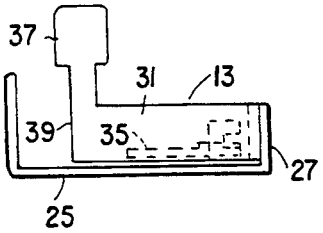
FIG. 4.
FIG. 5.
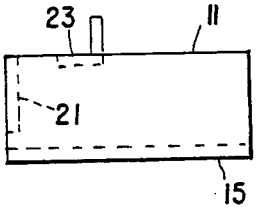
FIG. 6.
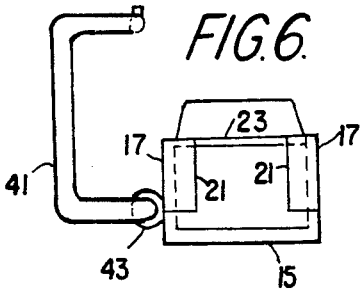

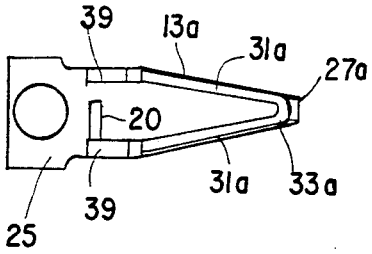
FIG. 7.
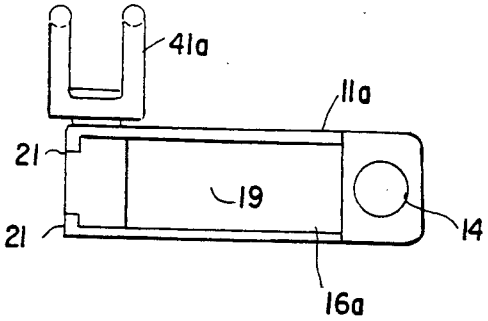
FIG. 8.
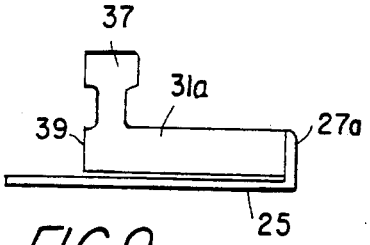
FIG. 9.
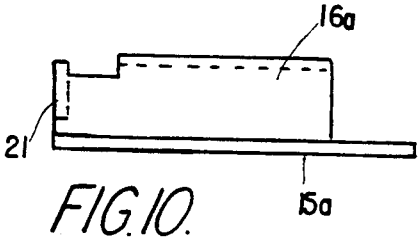
FIG. 10.
FIG. 11.
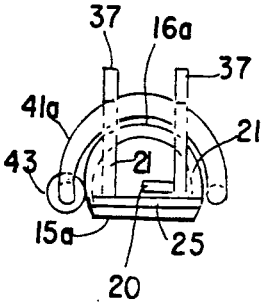

CONNECTOR DEVICE FOR JEWELRY

BACKGROUND AND SUMMARY OF THE INVENTION

This invention relates to a connector mechanism for releasably connecting the ends of a watchband, bracelet or necklace. The invention is in the connector mechanism; the watchband, bracelet or necklace is conventional.

Various connector mechanisms have been devised to releasably connect the ends of a bracelet or necklace. U.S. Pat. No. 3,308,517 shows one such mechanism. The present invention contemplates a connector mechanism that is relatively strong while being capable of manufacture as a relatively small device that does not significantly detract from the ornamental appearance of the necklace or bracelet to which it is attached. Two small handles are incorporated into the connector mechanism for unlocking a male component from a female component; after the two handles have been squeezed together the male component can be slidably withdrawn from the hollow female component.

The connector mechanism of this invention includes two inturned flanges within the hollow female component; two swingable resiliently-biased arms are carried on the cooperating male component. As the male component is inserted into the female component the swingable arms ride against the edges of the inturned flanges; as the trailing ends of the arms pass through the plane of the inturned flanges the arms snap outwardly away from each other so that the arm ends then spring into locking registry with the flanges. The structural combination achieves a balanced locking action that is resistant to bending failure or gradual degradation due to frictional wear.

THE DRAWINGS

FIG. 1 is a top plan view of a male connector component usable in practice of the invention.

FIG. 2 is a top plan view of a hollow female connector component adapted to mate with the FIG. 1 connector component.

FIG. 3 is a view taken in the same direction as FIGS. 1 and 2, but showing the male component inserted into the female component.

FIG. 4 is a side elevational view of the FIG. 1 component.

FIG. 5 is a side elevational view of the FIG. 2 component.

FIG. 6 is a left end view of the FIG. 5 component.

FIG. 7 is a top plan view of another male connector component used in a second embodiment of the invention.

FIG. 8 is a top plan view of a hollow female connector component usable with the FIG. 7 component.

FIG. 9 is a side elevational view of the FIG. 7 component.

FIG. 10 is a side elevational view of the FIG. 9 component.

FIG. 11 is a left end view of an assembled connector mechanism embodying the connector components of FIGS. 7 and 8.

DESCRIPTION OF PREFERRED EMBODIMENTS OF THE INVENTION

FIGS. 1 through 6 collectively illustrate a connector mechanism constitute one embodiment of the invention.

The mechanism comprises a hollow female component 11 that can be attached at its rightmost end to one end of a bracelet or necklace, not shown. A second male component !3 is attachable at its leftmost end to the other end of the bracelet or necklace. The male component is slidable into the female component to form a secure connection between the ends of the necklace or bracelet. FIG. 3 shows the two components slidably mated together.

Female component 11 includes a flat bottom wall 15 and two upstanding side walls 17 spaced apart to form an imaginary central slide axis 19. Inturned flanges 21 are formed at both ends of side walls 17. A top wall 23 extends across the two side walls at a point spaced rightwardly from flanges 21; wall 23 acts as a tie means between walls 17, thereby rigidifying component 11 into a relatively strong rectangular tubular configuration, as viewed in FIG. 6.

Male component 13 comprises a flat bottom plate 25 adapted to slide on the upper face of bottom wall 15 of female component 11. Plate 25 terminates at its right end in a convergent nose portion; the extreme right end of plate 25 is upturned to form a post 27 that constitutes a mounting mechanism for two swingable arms 31. As best seen in FIG. 1, these two arms are interconnected by a generally U-shaped bridging portion 33 that is preferably integral with the two arms. These two swingable arms and intermediate bridging portion are preferably formed out of a single strip of flat strip stock bent into the FIG. 1 configuration. FIG. 1 shows the two swingable arms in their unstressed at-rest conditions. Bridging portion 33 is brazed or otherwise attached to post 27 so that arms 31 can swing around the post (axis). The lower edges of arms 31 are spaced from plate 25 to enable the arms to swing toward or away from the central longitudinal axis 30 of the male component.

A small wire spring 35, having a hairpin configuration, is mounted within male component 13 to exert outward forces on arms 31. When the arms are moved toward axis 30 spring 35 exerts a spreader force on the arms so that the arms return to the FIG. 1 positions. Two handles 37 project upwardly from arms 31 near their left ends 39; ends 39 are sometimes referred to as the trailing ends of arms 31, in that ends 39 constitute the rear end of the arms when male component 13 is slidably inserted into female component 11. Handles 37 are preferably integral planar extensions of the associated arms 31.

Handles 37 are manually squeezable to move the trailing ends of arms 31 toward axis 30. When the manual squeeze pressure is removed the arms return to their FIG. 1 conditions. To mate the two components 11 and 13 together, male component 13 is moved rightwardly into component 11; the outer faces of arms 31 ride on the edges of inturned flanges 21 so that arms swing toward axis 30. Component 13 is moved until trailing ends 39 of arms 31 pass across the plane of flanges 21; the arms then spring outwardly so that arm ends 39 move into locking registry with the rightmost faces of flanges 21. FIG. 3 shows the two components 11 and 13 mated together, with component 13 slidably inserted into component 11. 20 is a part preventing arms 31 from bending too much when opening or closing the lock.

A safety lock device is provided to preclude inadvertant movement of handles 37. The safety lock device comprises a concave U-shaped gate 41 formed out of wire. A sleeve 43 is affixed to one of side walls 17 to form a hinge connection between the gate and component 11. The gate can swing from an open "non-obstruct" position extending away from component 11 (FIG. 6) to a closed position encircling the two handles 37 (as shown in FIG. 3). The gate includes two parallel wire sections 45 that snap around and then underneath the edges of handles 37 to retain the gate in its closed "handle obstruct" position. Gate 41 is a safety feature that is not essential to operational performance of the connector mechanism defined by components 11 and 13.

FIGS. 7 through 11 illustrate features of another embodiment of the invention. The hollow female component 11*a* is a tubular structure having a flat bottom wall 15*a* and an arcuate upper wall 16*a* that forms two side walls defining a slide axis 19. Two inturned flanges 21 are formed at the left end of the tubular structure. A circular hole 14 is formed through wall 15*a* for attaching component 11*a* to one end of a necklace or bracelet.

A male connector component 13*a* comprises a flat plate 25 having an upstanding post 27*a* at its convergent right end. Two swingable spring arms 31*a* have bridging portion 33*a* affixed to the post. The two arms and bridging portion are formed of a single strip of spring metal, such that each arm has a self-contained resilient bias tending to move it to the FIG. 7 position.

Operation of the assembly (FIGS. 7 through 11) is quite similar to that of the first-described embodiment. Component 13*a* is slidably inserted into component 11*a* until the trailing ends 39 of arms 31*a* snap into locking registry with the right faces of flanges 21.

A swingable wire gate 41*a* is hingedly attached to a side wall of component 11*a* for movement to/from the closed position—With either form of the invention, the gate has to be swung to its open position (FIG. 6) before the male component can be separated from the hollow female component. Handles 37 are squeezed together, after which the male component 13 or 13*a* is pulled leftwardly out of the hollow component 11 or 11*a*.

The connector mechanism has a strong balanced double locking action, in that two laterally-spaced end surfaces 39 exert balanced lock forces against the associated flanges 21. Accidental unlocking of the connector mechanism is essentially precluded.

The drawings necessarily show specific embodiments of the invention. However, it will be appreciated that the invention can be practiced in other forms and configurations.

What is claimed:

1. A connector mechanism for releasably connecting the ends of a bracelet or necklace; said connector mechanism comprising a hollow female component having a slide axis, and a male component slidable into said female component along the slide axis; said female component comprising a bottom wall, two upstanding side walls spaced apart to form the aforementioned slide axis midway therebetween, and an inturned flange (21) extending right angularly from an entrance end of each upstanding side wall; said male component comprising a bottom plate adapted to slide on the bottom wall of the female component, said bottom plate having a convergent nose portion and an upstanding post extending right angularly from said plate at said convergent nose portion; said male component further comprising two cantilever arms swingably connected to said upstanding post for swinging motions toward or away from each other; each arm being formed out of flat strip material, with the major plane thereof extending normal to the plane of the associated bottom plate; each arm having a trailing end engageable against one of the inturned flanges for preventing removal of the male component from the female component; said arms being resiliently biased outwardly away from the centerline of the male component so that when the male component is inserted into the female component the arms ride along said internal flanges until the trailing ends of the arms pass through the plane of the inturned flanges, at which time the arms spring away from each other so that the ends of the arms extend outwardly into locking registry with said flanges; the dimension of each flange normal to the associated bottom wall being approximately the same as the width of each arm measured in the major plane of the flat strip material, whereby each flange has substantial area contact with the trailing end of the associated arm.

2. The connector mechanism of claim 1, and further comprising two handles extending from said swingable arms at their trailing ends; said handles being swingable toward each other to move the arms toward the centerline of the male component whereby the trailing ends of the arms can be disengaged from the inturned flanges to permit separation of the male component from the female component; each handle being an integral flat planar extension of the associated flat strip.

3. The connector mechanism of claim 2, and further comprising a U-shaped bridging portion (33) forming a mounting connection between the two cantilever arms; said arms and said bridging portion being formed out of a single flat strip of material, with the bridging portion being wrapped around said post for rigid connection thereto.

4. The connector mechanism of claim 2, wherein said post is formed by an upturned end portion of said bottom plate; said post and bottom plate being an integral one piece construction

5. The connector mechanism of claim 2, and further comprising a concave safety lock gate swingably attached to one of the side walls of the female component for swinging motion around an axis parallel to the slide axis; said gate being swingable between a non-obstruct position extending away from the female component and a component-obstruct position encircling said handles.

6. The connector mechanism of claim 5, wherein said gate is formed out of wire; said wire gate having two parallel wire sections (45) adapted to snap around and then underneath said handles so as to exert a grip action thereon.

* * * * *